US008147121B2

(12) United States Patent
Lacy et al.

(10) Patent No.: US 8,147,121 B2
(45) Date of Patent: Apr. 3, 2012

(54) PRE-MIXING APPARATUS FOR A TURBINE ENGINE

(75) Inventors: Benjamin Paul Lacy, Greer, SC (US); Balachandar Varatharajan, Cincinnati, OH (US); Willy Steve Ziminsky, Simpsonville, SC (US); Gilbert Otto Kraemer, Greer, SC (US); Ertan Yilmaz, Albany, NY (US); Patrick Benedict Melton, Horse Shoe, NC (US); Baifang Zuo, Simpsonville, SC (US); Christian Xavier Stevenson, Inman, SC (US); David Kenton Felling, Greenville, SC (US); Jong Ho Uhm, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 914 days.

(21) Appl. No.: 12/169,865

(22) Filed: Jul. 9, 2008

(65) Prior Publication Data

US 2010/0008179 A1 Jan. 14, 2010

(51) Int. Cl.

| | |
|---|---|
| ***B01F 15/02*** | (2006.01) |
| ***B01F 5/06*** | (2006.01) |
| ***B01F 15/00*** | (2006.01) |

(52) U.S. Cl. ..... 366/134; 366/131; 366/182.1; 366/182.2; 366/182.3; 366/181.5; 366/338; 366/339; 366/181.6; 366/173.1; 366/173.2

(58) Field of Classification Search ..... 366/131, 366/134, 182.1, 182.2, 182.3, 181.5, 338, 366/339, 189.4, 173.1, 173.2, 181.6
See application file for complete search history.

(56) References Cited

U.S. PATENT DOCUMENTS

| | | | | |
|---|---|---|---|---|
| 4,100,733 | A | 7/1978 | Striebel et al. | |
| 4,429,527 | A | 2/1984 | Teets | |
| 4,845,952 | A | 7/1989 | Beebe | |
| 5,263,325 | A | 11/1993 | McVey et al. | |
| 5,339,635 | A | 8/1994 | Iwai et al. | |
| 5,680,766 | A * | 10/1997 | Joshi et al. | 60/746 |
| 5,746,048 | A * | 5/1998 | Shah | 60/776 |
| 5,865,030 | A | 2/1999 | Matsuhama | |
| 5,930,999 | A | 8/1999 | Howell et al. | |
| 6,019,596 | A | 2/2000 | Knopfel et al. | |
| 6,438,961 | B2 | 8/2002 | Tuthill et al. | |
| 6,442,939 | B1 | 9/2002 | Stuttaford et al. | |
| 6,453,673 | B1 | 9/2002 | Bechtel et al. | |
| 6,672,073 | B2 | 1/2004 | Wiebe | |
| 6,993,916 | B2 | 2/2006 | Johnson et al. | |
| 7,107,772 | B2 | 9/2006 | Chen et al. | |
| 7,412,833 | B2 | 8/2008 | Widener | |
| 7,556,031 | B2 * | 7/2009 | Russell | 123/590 |
| 7,886,991 | B2 | 2/2011 | Zuo et al. | |

(Continued)

*Primary Examiner* — Khanh P Nguyen
*Assistant Examiner* — Matthew Hoover
(74) *Attorney, Agent, or Firm* — Cantor Colburn LLP

(57) ABSTRACT

A pre-mixing apparatus for a turbine engine includes a main body having an inlet portion, an outlet portion and an exterior wall that collectively establish at least one fluid delivery plenum, and a plurality of fluid delivery tubes extending through at least a portion of the at least one fluid delivery plenum. Each of the plurality of fluid delivery tubes includes at least one fluid delivery opening fluidly connected to the at least one fluid delivery plenum. With this arrangement, a first fluid is selectively delivered to the at least one fluid delivery plenum, passed through the at least one fluid delivery opening and mixed with a second fluid flowing through the plurality of fluid delivery tubes prior to being combusted in a combustion chamber of a turbine engine.

15 Claims, 7 Drawing Sheets

U.S. PATENT DOCUMENTS

2007/0062197 A1 3/2007 Hannum et al.
2008/0078160 A1 4/2008 Kraemer et al.
2009/0229269 A1 9/2009 Lacy et al.
2010/0008179 A1 1/2010 Lacy et al.
2010/0031662 A1 2/2010 Zuo
2010/0101229 A1 4/2010 York et al.

* cited by examiner

PRE-MIXING APPARATUS FOR A TURBINE ENGINE

This invention was made with Government support under Contract No. DE-FC26-05NT4263, awarded by the US Department of Energy (DOE). The Government has certain rights in this invention.

BACKGROUND OF THE INVENTION

Exemplary embodiments of the invention pertain to the art of turbomachine combustion systems and, more particularly, to a pre-mixing apparatus for a turbomachine combustor.

In general, gas turbine engines combust a fuel/air mixture which releases heat energy to form a high temperature gas stream. The high temperature gas stream is channeled to a turbine via a hot gas path. The turbine converts thermal energy from the high temperature gas stream to mechanical energy that rotates a turbine shaft. The shaft may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels.

Low NOx levels can be achieved by ensuring very good mixing of the fuel and air. Various techniques, such as Dry-low NOx (DLN) combustors including lean premixed combustors and lean direct injection combustors, are utilized to ensure proper mixing. In turbines that employ lean pre-mixed combustors, fuel is pre-mixed with air in a pre-mixing apparatus prior to being admitted to a reaction or combustion zone. Pre-mixing reduces combustion temperatures and, as a consequence, also reduces NOx output. However, depending on the particular fuel employed, pre-mixing may cause auto-ignition, flashback and/or flame holding within the pre-mixing apparatus.

In turbines that employ lean direct injection (LDI) concepts, fuel and air are introduced directly and separately into a combustion liner arranged at an upstream end of a combustor prior to mixing. However, some systems that employ LDI concepts experience difficulties in rapid and uniform mixing of lean-fuel and rich-air within the combustion liner. Local flame temperatures in such zones may exceed minimum NOx formation threshold temperatures and elevate the production of NOx to unacceptable levels. In certain cases, diluents are added to reduce NOx levels. However, inert diluents are not always readily available, may adversely affect engine heat rate, and may increase capital and operating costs.

Other systems may employ a combustor having a dilution zone situated downstream of the reaction zone. In this case, inert diluents are introduced directly into the dilution zone and mix with the fuel/air mixture to achieve a pre-determined mixture and/or temperature of the gas stream entering the turbine section. However, as discussed above, inert diluents are not always available, may adversely affect engine heat rate and may increase capital and operating costs. Moreover, adding diluents downstream of the reaction zone does not provide any significant improvement in NOx levels.

BRIEF DESCRIPTION OF THE INVENTION

In accordance with one exemplary embodiment of the invention, a pre-mixing apparatus for a turbine engine includes a main body having an inlet portion, an outlet portion and an exterior wall that collectively establish at least one fluid delivery plenum, and a plurality of fluid delivery tubes extending through at least a portion of the at least one fluid delivery plenum. Each of the plurality of fluid delivery tubes includes at least one fluid delivery opening fluidly connected to the at least one fluid delivery plenum. With this arrangement, a first fluid is selectively delivered to the at least one fluid delivery plenum, passed through the at least one fluid delivery opening and mixed with a second fluid flowing through the plurality of fluid delivery tubes prior to being combusted in a combustion chamber of a turbine engine.

In accordance with another exemplary embodiment of the invention, a method of forming a combustible mixture in a mixing apparatus having a main body including an inlet portion, an outlet portion and an exterior wall that collectively establish at least one fluid delivery plenum is provided. The method includes guiding a first fluid into the at least one fluid delivery plenum, and delivering a second fluid though a plurality of fluid delivery tubes that extend through the at least one fluid delivery plenum. Each of the plurality of fluid delivery tubes includes an inlet end section, an outlet end section and an intermediate section. The method further includes passing the first fluid through a fluid delivery opening formed in each of the plurality of fluid delivery tubes, mixing the first and second fluids in the plurality of fluid delivery tubes, and delivering the first and second fluids from the outlet end section of each of the plurality of fluid delivery tubes into a combustion chamber.

In accordance with still another exemplary embodiment of the invention, a turbine engine includes at least one first fluid source containing a first fluid, at least one second fluid source containing a second fluid, and an apparatus for mixing the at least one first fluid and the at least one second fluid. The apparatus includes a main body having an inlet portion, an outlet portion and an exterior wall that collectively establish at least one fluid delivery plenum, and a plurality of fluid delivery tubes that extend through the at least one fluid delivery plenum. Each of the plurality of fluid delivery tubes includes a first end section exposed at the inlet portion of the main body, a second end section exposed at the outlet portion of the main body and an intermediate section, and at least one fluid delivery opening fluidly connected to the at least one fluid delivery plenum. With this arrangement, the first fluid is selectively delivered to the at least one fluid delivery plenum, passed through the at least one fluid delivery opening and mixed with the second fluid flowing through at least a portion of the plurality of fluid delivery tubes prior to being combusted in a combustion chamber of the turbine engine.

DETAILED DESCRIPTION OF THE INVENTION

Figure 1:
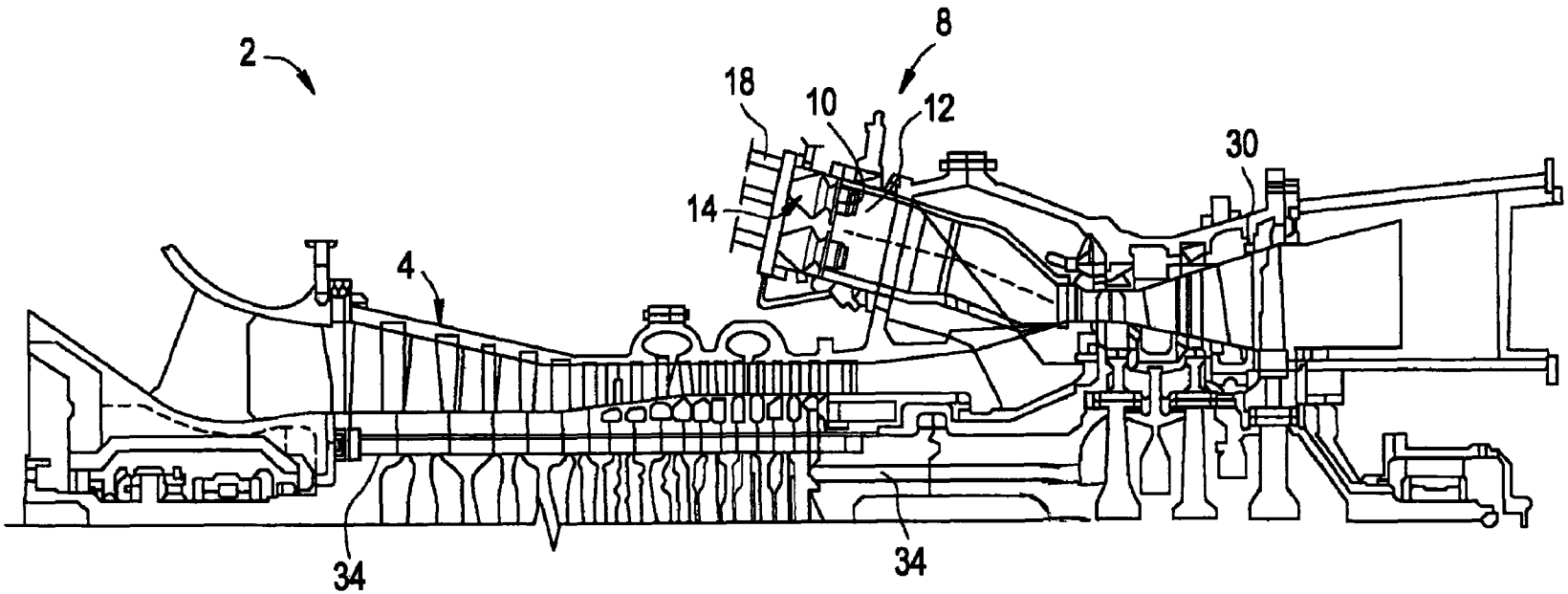
FIG. 1 is a cross-sectional side view of an exemplary gas turbine engine including a pre-mixing apparatus constructed in accordance with an exemplary embodiment of the invention.

FIG. 1 is a schematic illustration of an exemplary gas turbine engine 2. Engine 2 includes a compressor 4 and a combustor assembly 8. Combustor assembly 8 includes a combustor assembly wall 10 that at least partially defines a combustion chamber 12. A pre-mixing apparatus or nozzle 14 extends through combustor assembly wall 10 and leads into combustion chamber 12. As will be discussed more fully below, nozzle 14 receives a first fluid or fuel through a fuel inlet 18 and a second fluid or compressed air from compressor 4. The fuel and compressed air are mixed, passed into combustion chamber 12 and ignited to form a high temperature, high pressure combustion product or air stream. Although only a single combustor assembly 8 is shown in the exemplary embodiment, engine 2 may include a plurality of combustor assemblies 8. In any event, engine 2 also includes a turbine 30 and a compressor/turbine shaft 34 (sometimes referred to as a rotor). In a manner known in the art, turbine 30 is coupled to, and drives, shaft 34 that, in turn, drives compressor 4.

In operation, air flows into compressor 4 and is compressed into a high pressure gas. The high pressure gas is supplied to combustor assembly 8 and mixed with fuel, for example process gas and/or synthetic gas (syngas), in nozzle 14. The fuel/air or combustible mixture is passed into combustion chamber 12 and ignited to form a high pressure, high temperature combustion gas stream. Alternatively, combustor assembly 8 can combust fuels that include, but are not limited to natural gas and/or fuel oil. In any event, combustor assembly 8 channels the combustion gas stream to turbine 30 which coverts thermal energy to mechanical, rotational energy.

Figure 2:
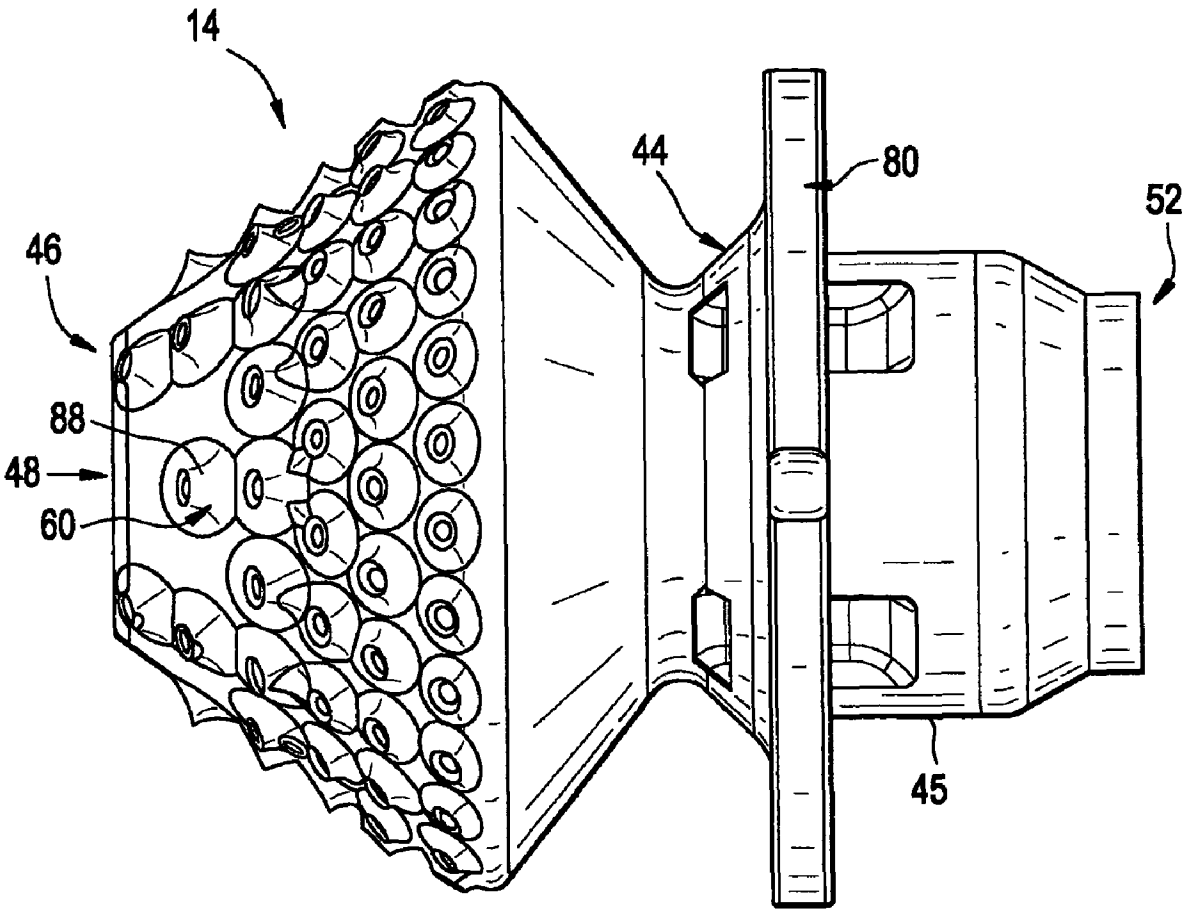
FIG. 2 is a side elevational view of a pre-mixing apparatus of FIG. 1.
Figure 3:
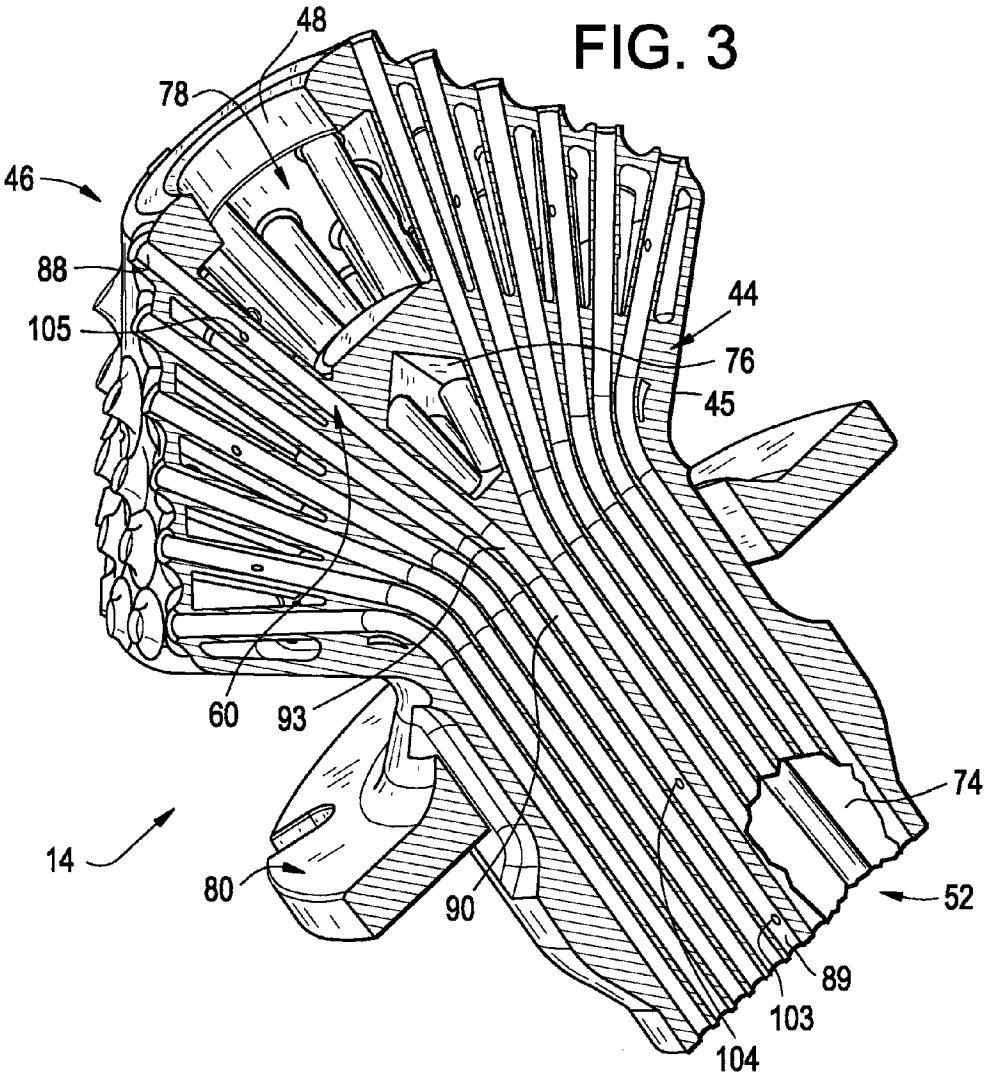
FIG. 3 is a cross-sectional side view of the pre-mixing apparatus of FIG. 2.
Figure 4:
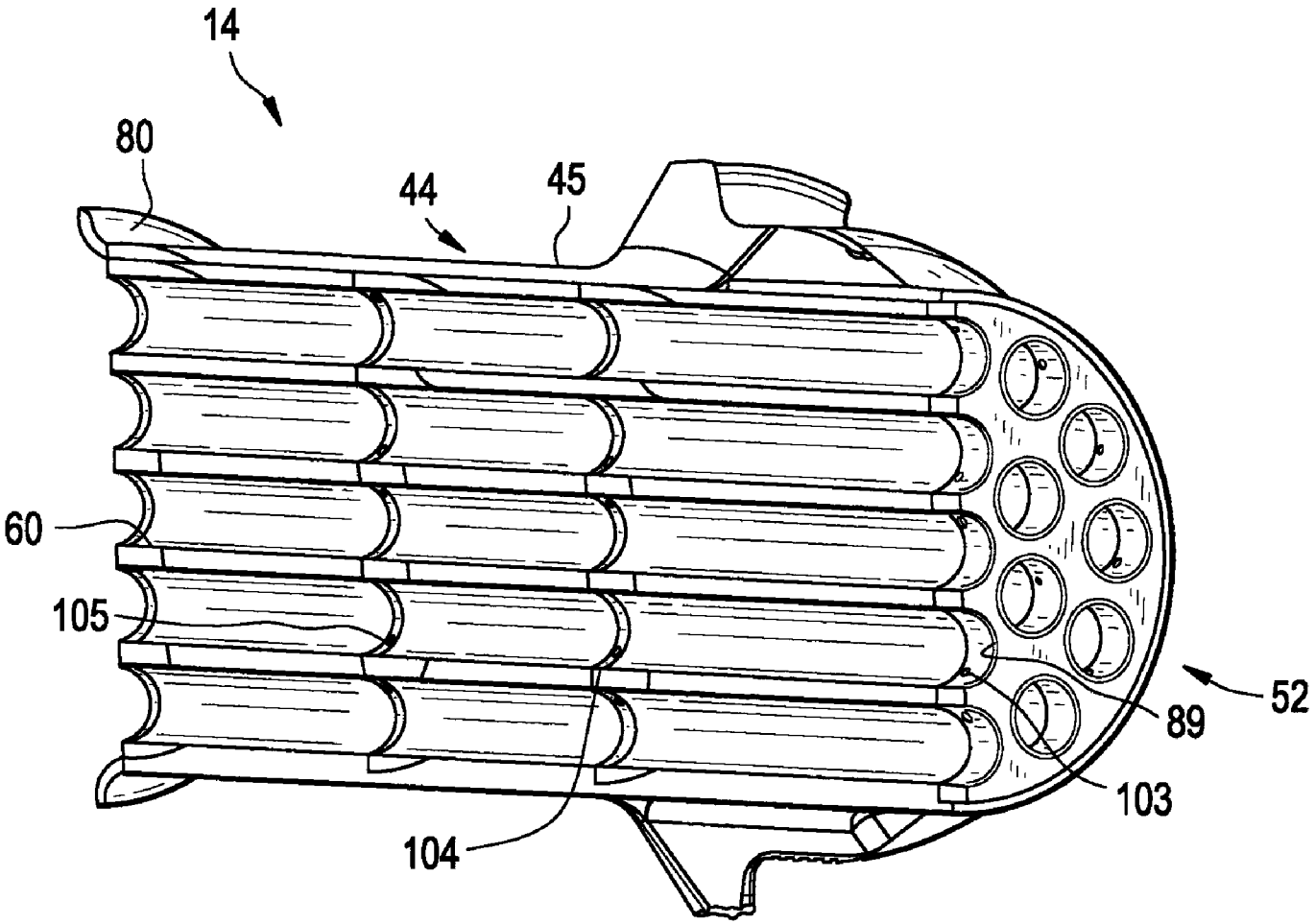
FIG. 4 is a cross-sectional perspective view of an outlet portion of the pre-mixing apparatus in accordance with another exemplary embodiment of the invention utilizing straight tubes instead of angled tubes as well as an alternative fuel input.

Reference will now be made to FIGS. 2-4 in describing nozzle 14 constructed in accordance with an exemplary embodiment of the invention. As shown, nozzle 14 includes a main body 44 having an exterior wall 45 that defines an inlet portion 46 including a first fluid inlet 48, and an outlet portion 52 from which the combustible mixture passes into combustion chamber 12. Nozzle 14 further includes a plurality of fluid delivery or mixing tubes, one of which is indicated at 60, that extend between inlet portion 46 and outlet portion 52 as well as a plurality of fluid delivery plenums 74, 76 and 78 that selectively deliver a first fluid and or other substances to delivery tubes 60 as will be discussed more fully below. In the exemplary embodiment shown, plenum 74 defines a first plenum arranged proximate to outlet portion 52, plenum 76 defines an intermediate plenum arranged centrally within nozzle 14 and plenum 78 defines a third plenum arranged proximate to inlet portion 46. Finally, nozzle 14 is shown to include a mounting flange 80. Mounting flange 80 is employed to secure nozzle 14 to combustor assembly wall 10.

Tube 60 provides a passage for delivering the second fluid and the combustible mixture into combustion chamber 12. It should be understood that more than one passage per tube could be provided, with each tube 60 being formed at a variety of angles depending upon operating requirements for engine 2 (FIGS. 2 and 3). Of course tube 60 can also be formed without angled sections such as shown in FIG. 4. As will become evident below, each tube 60 is constructed to ensure proper mixing of the first and second fluids prior to their introduction into combustion chamber 12. Towards that end, each tube 60 includes a first or inlet end section 88 provided at inlet portion 46, a second or outlet end section 89 provided at outlet portion 52 and an intermediate section 90.

In accordance with the exemplary embodiment shown, tube 60 includes a generally circular cross-section having a diameter that is sized based on enhancing performance and manufacturability. As will be discussed more fully below, the diameter of tube 60 could vary along a length of tube 60. In accordance with one example, tube 60 is formed having a diameter of approximately 2.54 mm-22.23 mm or larger. Tube 60 also includes a length that is approximately ten (10) times the diameter. Of course, the particular diameter and length relationship can vary depending on the particular application chosen for engine 2. In further accordance with the embodiment shown, intermediate section 90, shown in FIGS. 2 and 3, includes an angled portion 93 such that inlet end section 88 extends along an axis that is offset relative to outlet end section 89. Angled portion 93 facilitates mixing of the first and second fluids by creating a spiraling action within tube 60. In addition to facilitating mixing, angled portion 93 creates space for plenums 74, 76 and 78. Of course, tube 60 could be formed without angled portion 93 depending upon construction and/or operation needs, as shown in FIG. 4, with first fluid inlet 48 is located at side portions thereof or the like.

In accordance with the exemplary embodiment illustrated in FIGS. 1-4, each tube 60 includes a first fluid delivery opening 103 arranged proximate to outlet end section 89 and fluidly connected to first plenum 74, a second fluid delivery opening 104 arranged along intermediate section 90 and fluidly connected to second plenum 76 and a third fluid delivery opening 105 arranged substantially spaced from inlet end section 88 and upstream of first and second fluid delivery openings 103 and 104. Third fluid delivery opening 105 is fluidly connected to third plenum 78. Fluid delivery openings 103-105 could be formed at a variety of angles depending upon the particular application in which engine 2 is employed. In accordance with one exemplary aspect of the invention, a shallow angle is employed in order to allow the fuel to assist the air flowing through tube 60 and minimize any pressure drop. In addition, a shallow angle minimizes any potential disturbances in the air flow caused by a fuel filter. In accordance with another exemplary aspect, tube 60 is formed having a decreasing diameter that creates a region of higher velocity flow at, for example, first fluid delivery opening 103 to reduce flame holding potential. The diameter then increases downstream to provide pressure recovery. With this arrangement, first fluid delivery opening 104 enables recessed, lean direct injection of the combustible mixture, second fluid delivery opening 103 enables a partially premixed combustible mixture injection and third fluid delivery opening 105 enables fully premixed combustible mixture delivery into combustion chamber 12.

More specifically, first fluid delivering opening 103 enables the introduction of the first fluid or fuel into tube 60 which already contains a stream of second fluid or air. The particular location of first fluid delivery opening 103 ensures that the first fluid mixes with the second fluid just prior to entering combustion chamber 12. In this manner, fuel and air remain substantially unmixed until entering combustion chamber 12. Second fluid delivery opening 104 enables the introduction of the first fluid into the second fluid at a point spaced from outlet end section 89. By spacing second first fluid delivery opening 104 from outlet end section 89, fuel and air are allowed to partially mix prior to being introduced into combustion chamber 12. Finally, third fluid delivery opening 105 is substantially spaced from outlet end section 89 and preferably up-stream from angled portion 93, so that the first fluid and second fluid are substantially completely pre-mixed prior to being introduced into combustion chamber 12. As the fuel and air travel along tube 60, angled portion 93 creates a swirling action that contributes to mixing. In addition to forming fluid delivery openings 103-105 at a variety of angles, protrusions could be added to each tube 60 that direct the fluid off of tube walls (not separately labeled). The protrusions can be formed at the same angle as the corresponding fluid delivery opening 103-105 or at a different angle in order to adjust an injection angle of incoming fluid.

With this overall arrangement, fuel is selectively delivered through first fluid inlet 48 and into one or more of plenums 74, 76 and 78 to mix with air at different points along tube 60 in order to adjust the fuel/air mixture and accommodate differences in ambient or operating conditions. That is, fully mixed fuel/air tends to produce lower NOx levels than partially or un-mixed fuel/air. However, under cold start and/or turn down conditions, richer mixtures are preferable. Thus, exemplary embodiments of the invention advantageously provide for greater control over combustion byproducts by selectively controlling the fuel/air mixture in order to accommodate various operating or ambient conditions of engine 2.

In addition to selectively introducing fuel, other substances or diluents can be introduced into the fuel/air mixture to adjust combustion characteristics. That is, while fuel is typically introduced into third plenum 78, diluents can be introduced into, for example, second plenum 76 and mixed with the fuel and air prior to being introduced into combustion chamber 12. Another benefit of the above-arrangement is that fuel or other substances in plenums 74, 76 and 78 will cool the fuel/air mixture passing through tube 60 quenching the flame and thus provide better flame holding capabilities. In any event, while there are obvious benefits to multiple plenums and delivery openings, it should be understood that nozzle 14 could be formed with a single fuel delivery opening fluidly connected to a single fuel plenum that is strategically positioned to facilitate efficient combustion in order to accommodate various applications for engine 2. Moreover, nozzle 14 could be provided with any other number of openings/plenums depending on various operating parameters, ambient conditions and combustion goals of engine 2.

FIGS. 5-8 illustrate various tube configurations for premixing nozzles constructed in accordance with other exemplary embodiments of the invention. That is, it should be understood that the nozzles illustrated in FIGS. 5-8 include structure similar to nozzle 14 but for the various disclosed aspects. In any event, reference will now be made to FIG. 5 in describing a nozzle 140 constructed in accordance with another exemplary embodiment of the invention. Nozzle 140 includes a main body 142 having an exterior wall 144 that establishes a fluid plenum (not shown). Nozzle 140 includes an outlet portion 146 and a plurality of tubes, one of which is indicated at 148. In the exemplary embodiment shown, tube 148 has a generally rectangular cross-section. This particular configuration enables a closer packing of tubes 148 within nozzle 140. That is, tubes having a rectangular cross-section can be placed in close proximity to one another. In contrast, when placing fluid delivery tubes having a circular cross-section in close proximity, such as by "close packing", discrete interstitial spaces remain that prevent the fluid delivery tubes from being brought closer together.

Figure 6:
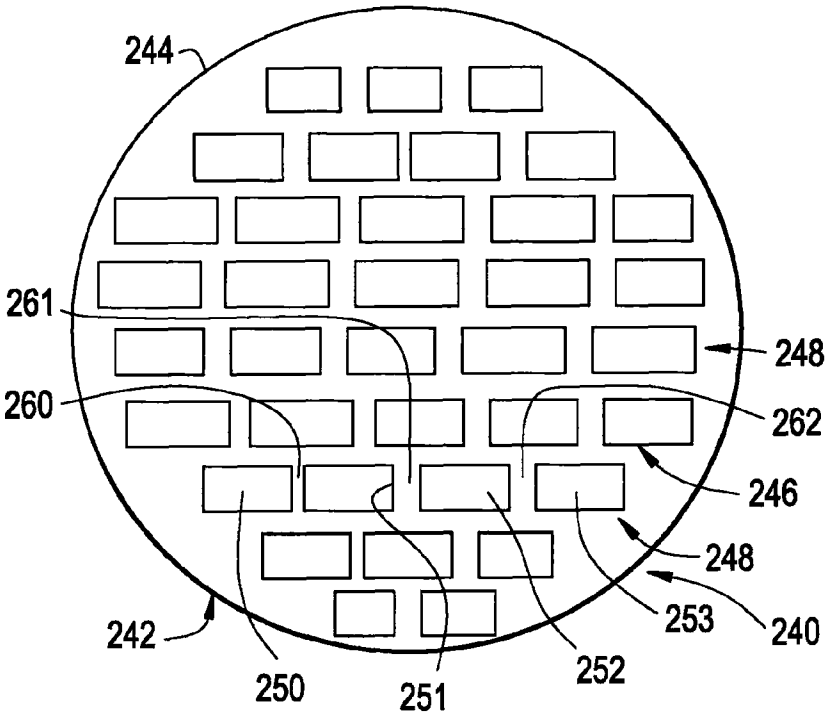
FIG. 6 is an elevational view of an outlet portion of a pre-mixing apparatus constructed in accordance with still another exemplary embodiment of the invention.
Figure 5:
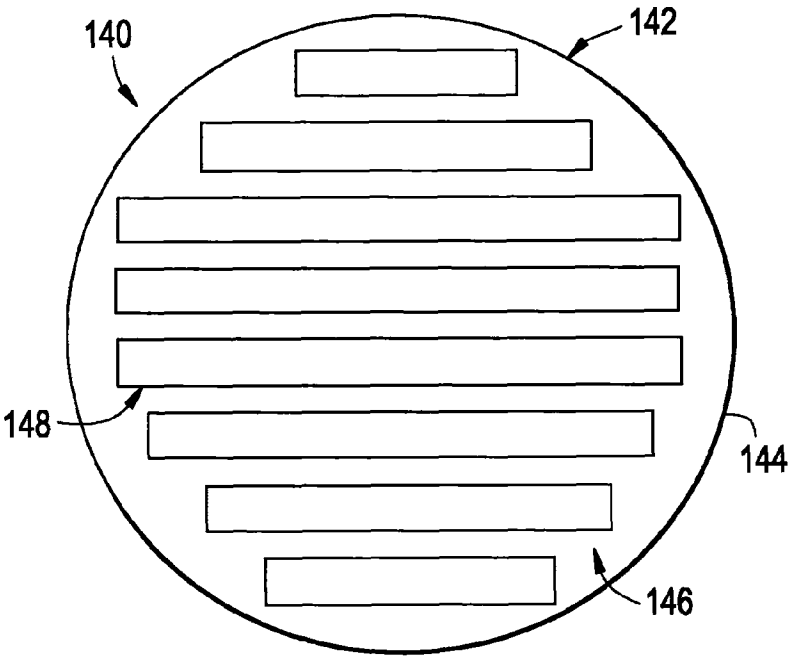
FIG. 5 is an elevational view of an outlet portion of a pre-mixing apparatus constructed in accordance with another exemplary embodiment of the invention.

Reference will now be made to FIG. 6 in describing a nozzle 240 constructed in accordance with still another exemplary embodiment of the invention. Nozzle 240 includes a main body 242 having an exterior wall 244 that establishes a fluid plenum (not shown). Nozzle 240 includes an outlet portion 246 and a plurality of tubes, one of which is indicated at 248. In the exemplary embodiment shown, tube 248 has a generally rectangular cross-section that is separated into a plurality of internal passages 250-254 by a plurality of thin wall portions 260-263. Thin wall portions 260-263 are, in one embodiment, formed from thin foils, such as used in heat exchanger stock. Of course, other suitable materials could also be employed. In this manner multiple tubes can be easily formed with each tube having various internal contours, such as corrugations, to facilitate mixing.

Figure 7:
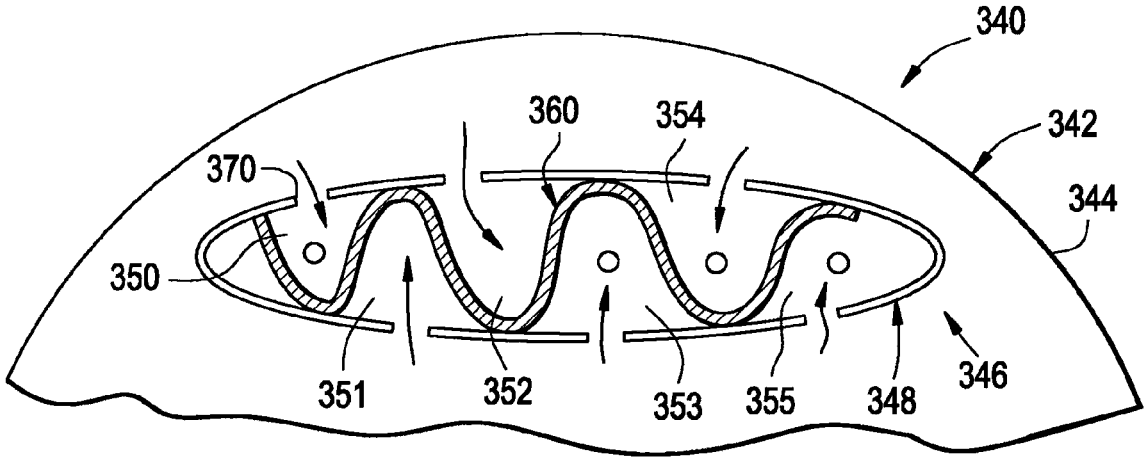
FIG. 7 is a partial elevational view of an outlet portion of a pre-mixing apparatus constructed in accordance with yet another exemplary embodiment of the invention.

FIG. 7 illustrates a nozzle 340 constructed in accordance with yet another exemplary embodiment of the invention. Nozzle 340 includes a main body 342 having an exterior wall 344 that establishes a fluid plenum (not shown). Nozzle 340 includes an outlet portion 346 and a plurality of tubes, one of which is indicated at 348. In the exemplary embodiment shown, tube 348 has a generally oval cross-section that is separated into a plurality of internal passages 350-355 by a serpentine wall member 360. With this arrangement each passage 350-355 includes a fluid delivery opening, one of which is indicated at 370 in passage 350. Serpentine wall 360 facilitates the mixing of fuel and air passing through passages 350-355.

Figure 8:
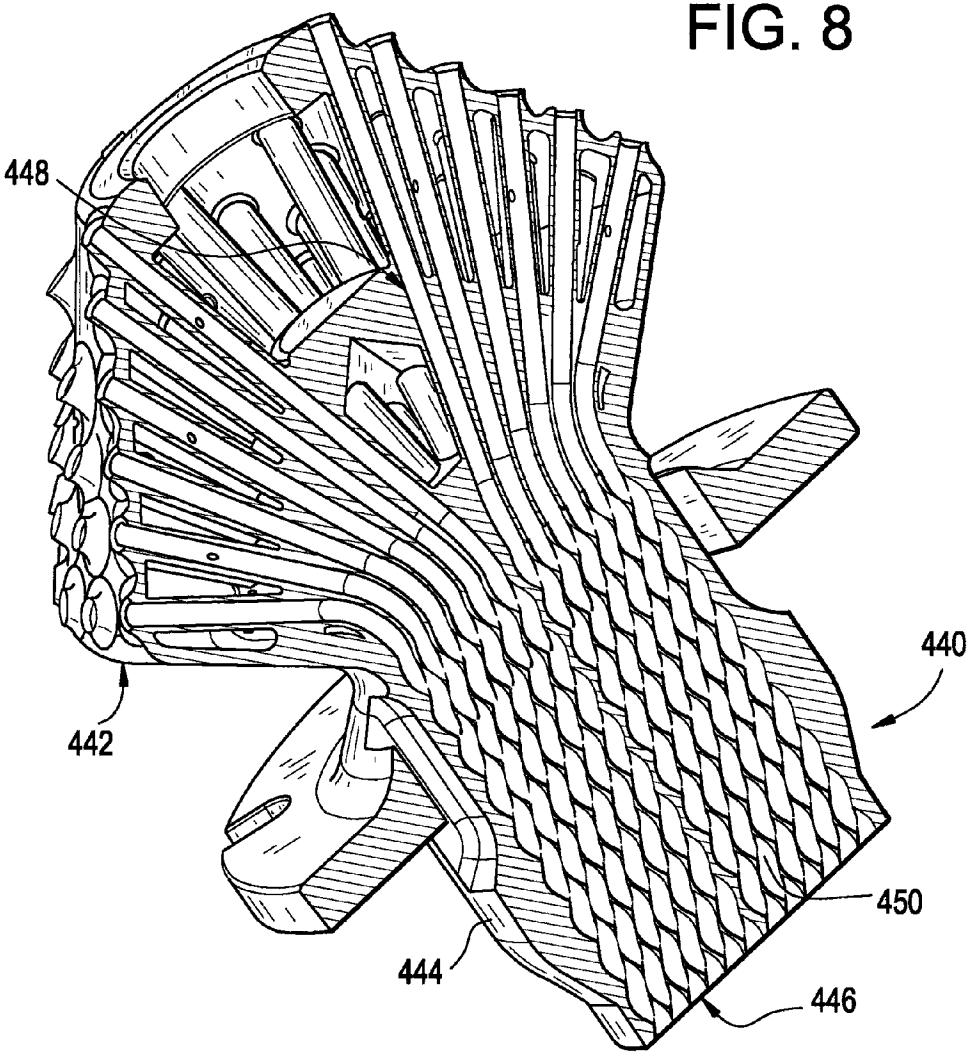
FIG. 8 is a cross-sectional view of a pre-mixing apparatus constructed in accordance with a further exemplary embodiment of the invention.

FIG. 8 illustrates a nozzle 440 constructed in accordance with yet another exemplary embodiment of the invention. Nozzle 440 includes a main body 442 having an exterior wall 444 that establishes a fluid plenum (not shown). Nozzle 440 includes an outlet portion 446 and a plurality of tubes, one of which is indicated at 448. In the exemplary embodiment shown, each delivery tube 448 includes a spiral section 450. In this configuration, a fluid delivery opening (not separately labeled) is provided upstream stream from each spiral section 450. In this manner, spiral portion 450 aides in fully mixing air and fuel passing through, for example, tube 448.

At this point it should be appreciated that the various exemplary embodiments of the present invention selectively enable various stages of mixing of the first and second fluids, e.g., fuel and air, to ensure that NOx levels remain within government mandated limits while simultaneously avoiding many of the drawbacks associated with other mixing devices such as auto-ignition, flashback and/or flame holding and high local flame temperatures.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A pre-mixing apparatus for a turbine engine comprising:

a main body having an inlet portion, an outlet portion and an exterior wall that collectively establish at least one fluid delivery plenum; and a plurality of fluid delivery tubes extending through at least a portion of the at least one fluid delivery plenum, each of the plurality of fluid delivery tubes including an inlet end section, an outlet end section, and at least one fluid delivery opening disposed between the inlet end section and the outlet end section and fluidly connected to the at least one fluid delivery plenum wherein, a first fluid is selectively delivered to the at least one fluid delivery plenum, passed through the at least one fluid delivery opening and mixed with a second fluid flowing through the plurality of fluid delivery tubes prior to being combusted in a combustion chamber of a turbine engine.

2. The pre-mixing apparatus according to claim 1, wherein the at least one fluid delivery opening being located proximate to the outlet end section so as to define a lean direct injection opening.

3. The pre-mixing apparatus according to claim 1, wherein the at least one fluid delivery opening being located slightly spaced from the inlet end section so as to define a partially pre-mixed lean direct injection opening.

4. The pre-mixing apparatus according to claim 1, wherein each of the plurality of fluid delivery tubes includes an outlet end section exposed at the outlet portion of the main body, an inlet end section exposed at the inlet portion of the main body and an intermediate section, the at least one fluid delivery opening is substantially spaced from the inlet end section so as to define a fully pre-mixed opening.

5. The pre-mixing apparatus according to claim 1, wherein the at least one fluid delivery plenum constitutes a plurality of fluid delivery plenums including a first plenum, a second plenum and a third plenum.

6. The pre-mixing apparatus according to claim 5, wherein the at least one fluid delivery opening in each of the plurality of fluid delivery tubes constitutes a plurality of fluid delivery openings including a first fluid delivery opening fluidly connected to the first fuel plenum, a second fluid delivery opening fluidly connected to the second plenum and a third fluid delivery opening fluidly connected to the third plenum.

7. The pre-mixing apparatus according to claim 6, wherein each of the plurality of fluid delivery tubes includes an inlet end section, the first fluid delivery opening is arranged proximate to the inlet end section.

8. The pre-mixing apparatus according to claim 7, wherein each of the plurality of fluid delivery tubes includes an inlet end section, the third fluid delivery opening is substantially spaced from the inlet end section.

9. The pre-mixing apparatus according to claim 8, wherein second fluid delivery opening is arranged between the first and third fluid delivery openings.

10. The pre-mixing apparatus according to claim 1, wherein at least one of the plurality of fluid delivery tubes includes an angled portion.

11. The pre-mixing apparatus according to claim 1, wherein, the inlet portion is fluidly connected to the at least one fluid delivery plenum.

12. The pre-mixing apparatus according to claim 1, wherein each of the plurality of fluid delivery tubes includes at least one of a substantially circular cross section and a rectangular cross section.

13. The pre-mixing apparatus according to claim 1, wherein each of the plurality of fluid delivery tubes includes at least one thin wall portion that establishes a plurality of fluid delivery passages.

14. The pre-mixing apparatus according to claim 1, wherein each of the plurality of fluid delivery tubes includes at least one of an oval cross-section having a serpentine wall member that establishes a plurality of internal passages, and a spiral section that facilitates mixing of the combustible mixture.

15. A turbine engine comprising:

at least one first fluid source containing a first fluid;

at least one second fluid source containing a second fluid; and an apparatus for mixing the at least one first fluid and the at least one second fluid including:

a main body having an inlet portion, an outlet portion and an exterior wall that collectively establish at least one fluid delivery plenum; and a plurality of fluid delivery tubes extending through the at least one fluid delivery plenum, each of the plurality of fluid delivery tubes including a first end section exposed at the inlet portion of the main body, a second end section exposed at the outlet portion of the main body and an intermediate section, and at least one fluid delivery opening disposed between the first end section and the second end section and fluidly connected to the at least one fluid delivery plenum, wherein the first fluid is selectively delivered to the at least one fluid delivery plenum, passed through the at least one fluid delivery opening and mixed with the second fluid flowing through at least a portion of the plurality of fluid delivery tubes prior to being combusted in a combustion chamber of the turbine engine.

* * * * *